US007116793B2

(12) United States Patent
Seto

(10) Patent No.: US 7,116,793 B2
(45) Date of Patent: Oct. 3, 2006

(54) EAR PAD, AND EARPHONE WITH THE PAD

(75) Inventor: Shinji Seto, Fukuoka (JP)

(73) Assignee: NAP Enterprise Co., Ltd., Fukuoka (JP)

( * ) Notice: Subject to any disclaimer, the term of this patent is extended or adjusted under 35 U.S.C. 154(b) by 28 days.

(21) Appl. No.: 10/511,030

(22) PCT Filed: Apr. 12, 2003

(86) PCT No.: PCT/JP03/03098

§ 371 (c)(1),
(2), (4) Date: Oct. 12, 2004

(87) PCT Pub. No.: WO03/088706

PCT Pub. Date: Oct. 23, 2003

(65) Prior Publication Data

US 2005/0141743 A1 Jun. 30, 2005

(30) Foreign Application Priority Data

Apr. 12, 2002 (JP) ..... 2002-111116

(51) Int. Cl.
*H04R 25/02* (2006.01)

(52) U.S. Cl. ..... 381/322; 181/130

(58) Field of Classification Search ..... 381/309, 381/328, 330, 338, 370, 380, 381, 382, 385, 381/322; 181/128, 129, 130, 135, 126
See application file for complete search history.

(56) References Cited

U.S. PATENT DOCUMENTS

| | | | | |
|---|---|---|---|---|
| 2,521,414 | A * | 9/1950 | Schier | 181/135 |
| 3,097,643 | A * | 7/1963 | Santi | 128/867 |
| 5,887,070 | A * | 3/1999 | Iseberg et al. | 381/380 |
| 5,979,589 | A * | 11/1999 | Aceti | 381/328 |
| 6,241,041 | B1 * | 6/2001 | Leight | 181/135 |

* cited by examiner

*Primary Examiner*—Sinh Tran
*Assistant Examiner*—Walter F Briney, III
(74) *Attorney, Agent, or Firm*—Flynn, Thiel, Boutell & Tanis, P.C.

(57) ABSTRACT

The ear pad according to the present invention has a number of gathered sound-insulating walls (12) monolithically provided on an outer periphery of a basic body (11) made of an elastic material such as rubber, for instance, a silicon rubber or soft synthetic resins, for instance, polypropylene in a ring form with a prescribed space in the axial direction and made of the same material as that for the basic body. With this feature, the ear pad according to the present invention can provide softness and adaptability to be set in an auditory means without stimulating sensitive portions thereof.

1 Claim, 4 Drawing Sheets

FIG. 1
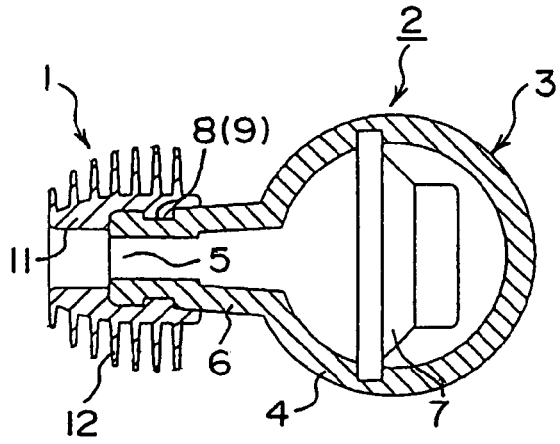
FIG. 2A
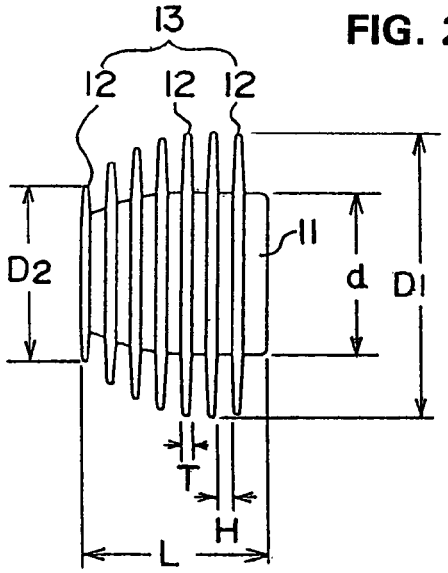
FIG. 2B
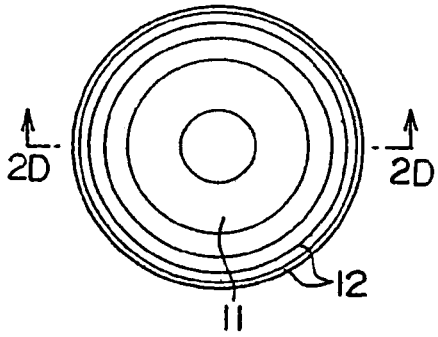
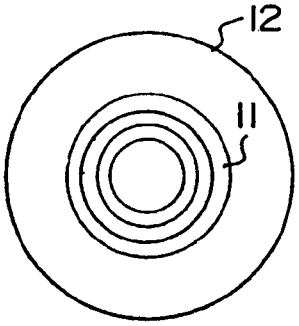
FIG. 2C
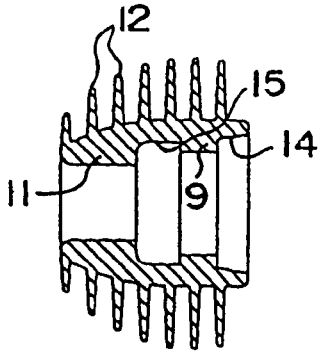
FIG. 2D

EAR PAD, AND EARPHONE WITH THE PAD

FIELD OF THE INVENTION

The present invention relates to an ear pad detachably set in an ear hole (auditory meatus) and an earphone with the pad.

BACKGROUND TECHNOLOGY

This type of ear pad 51 based on the conventional technology has, as shown in FIGS. 6 and 7, each showing the case in which the ear pad is applied to an ear plug, a fit section 53 slanted to the rear edge side and comprising, for instance, a thin and spherical silicone rubber sheet provided at a tip of a hollow and cylindrical basic body 52 and expanding toward a rear edge of the basic body 52, and because of the structure as described above, the ear pad can be fit in an auditory meatus with this fit section, and also provides flexibility to the size of an auditory meatus in the radial direction.

When the ear pad 51 as described above is inserted and set in an auditory meatus, the ear pad can be set therein because the fit section 53 provides softness, but as there is a tapered portion with the diameter gradually becoming smaller toward the depth thereof in the auditory meatus at its entrance, when the ear pad is inserted, the force P acting to crush the fit section 53 generates the force F to push back the ear pad as shown in the figures, so that the ear pad easily drops out. Only the frictional force between an external surface of the fit section 53 and the inner wall of the auditory meatus acts against the force P for pushing back the ear pad. Therefore, if the fit section 53 of the ear pad 51 is too soft, the frictional force becomes too small, and the ear pad easily drops out. On the contrary, if the fit section 53 is too hard, it presses the inner wall of an auditory meatus, and causes pain, even if the ear pad is set there only for a short period of time.

FIG. 8 is a cross-sectional view showing the situation where the fit section 53 of the ear pad 51 is deformed inside an auditory meatus. The form and size of an auditory meatus vary in each person, and the dimensional relations are delicate, and when the fit section 53 is inserted into a deeper position than the desired one, or when the fit section 53 is larger than the auditory meatus, there is no escaping space for deformation because of the monolithic structure of the spherical portion, so that deformation occurs to generate a clearance 55 on a portion of a periphery of the fit section 53 with the sound insulating properties degraded. Even if three types of ear pads, namely ear pads with small, medium, and large size are prepared to respond to the individual difference, at present it is difficult to completely overcome this problem. In addition, when the ear pad is set in an auditory meatus, an external surface of the fit section 53 closely contacts the internal wall of the auditory meatus on its entire surface, so that dermatitis often occurs in people having sensitive skin, and further if the ear pad is set for a long time, stimulation easily occurs due to becoming stuffy, and the ear pad easily drops out due to sweat or fat.

The present invention was made in the light of the circumstances described above, and it is an object to provide an ear pad having a softness and adaptability to being set in an auditory meatus without stimulating its sensitive portions, which can flexibly respond to individual differences and also can smoothly be set but is little affected by the decrease in the frictional force due to sweat or fat, which seldom generates becoming stuffy or dermatitis, even in people having sensitive skin, which can be used without causing any discomfort and is resistant even to the force acting in the releasing direction so that it hardly drops out, which can improve the capability of attenuating noises coming from the outside, and further, which is excellent in the sealing performance as well as in the sound insulating properties and also to provide an earphone with the pad.

DISCLOSURE OF THE INVENTION

To achieve the object as described above, the present invention provides an ear pad adapted to being inserted and detachably set in an auditory meatus and having the structure in which, on an outer peripheral surface of a hollow and cylindrical basic body made of an elastic material like rubber such as silicone rubber or a like soft resin such as polypropylene, a number of gathered sound-insulating walls made of the same material as the basic body are monolithically provided in a ring form at a prespecified space in the axial direction.

In the ear pad according to the present invention, the configuration is allowable in which the sound-insulating walls each contacting the inner wall of the auditory meatus at its peripheral edge bend to the rear edge side when the ear pad is set in an auditory meatus and a sealed space is formed between the bending and adjoining sound-insulating walls.

Also, the configuration is permitted in which a diameter of the sound-insulating wall becomes gradually smaller at its tip, and in this configuration, each of the sound-insulating walls is provided in the direction crossing the central axis of the basic body at right angles and the wall thickness becomes smaller toward the outer periphery.

The configuration is also permitted in which each of the sound-insulating walls has the same diameter of its entire portion and is slightly slanted to the rear edge side with the wall thickness becoming smaller toward the outer periphery. Further the sound-insulating wall may include air bubbles for sound absorption. The maximum outer diameter may be smaller than two times of the outer diameter of the basic body. In addition, not less than five and not more than ten sound-insulating walls may be provided on an external peripheral surface of the basic body.

With the present invention, the softness and adaptability to being set without stimulating sensitive portions of an auditory meatus are provided. In other words, even if there is the individual difference in the form or size of an auditory meatus, or even when an auditory meatus in the left ear of a person is different in its size or other parameters from that in the right ear of the same person, the ear pad can flexibly correspond to all of the differences in each person. In addition, the ear pad can smoothly and easily be set or detached, and is hardly affected by lowering of the frictional force due to sweat or fat, and different from a surface of the fit section based on the conventional design, the surface contacts with the inner wall of the auditory meatus at points, so that becoming stuffy or dermatitis seldom occurs in an ear, even in people having sensitive skin, so that no discomfort occurs even when the ear pad is set in an ear for a long period of time. Further, once set in an ear, the ear pad hardly drops out, so that stable adaptability to being set in an ear is provided. In the type of ear pad according to the present invention having the configuration in which a sealed space is formed between the sound-insulating walls, the extremely high capability of attenuating noises coming into an ear from the outside is provided.

The present invention provides an earphone which is characterized in that the ear pad is provided at a tip section of the basic body of the earphone.

With the present invention, it is possible to provide an earphone with the ear pad capable of providing the effects as described above. The earphone with the ear pad can prevent generation of an echo of received sounds by the speaker or other related components in an auditory meatus with its capability of attenuating sounds by the sealed spaces described above, and always enables excellent sound processing to insure high quality sounds.

DESCRIPTION OF THE DRAWINGS

FIG. 1 is a cross-sectional front view showing a cross section of an earphone microphone according to one embodiment of the present invention taken along the axial direction;

FIG. 2A is a front view showing an ear pad;

FIG. 2B is a side view showing the left side of the ear pad;

FIG. 2C is a side view showing the right side of the ear pad;

FIG. 2D is a cross-sectional front view showing a cross section of the ear pad taken along the line 2D to 2D in FIG. 2B;

BEST MODE FOR CARRYING OUT THE INVENTION

Figure 3:
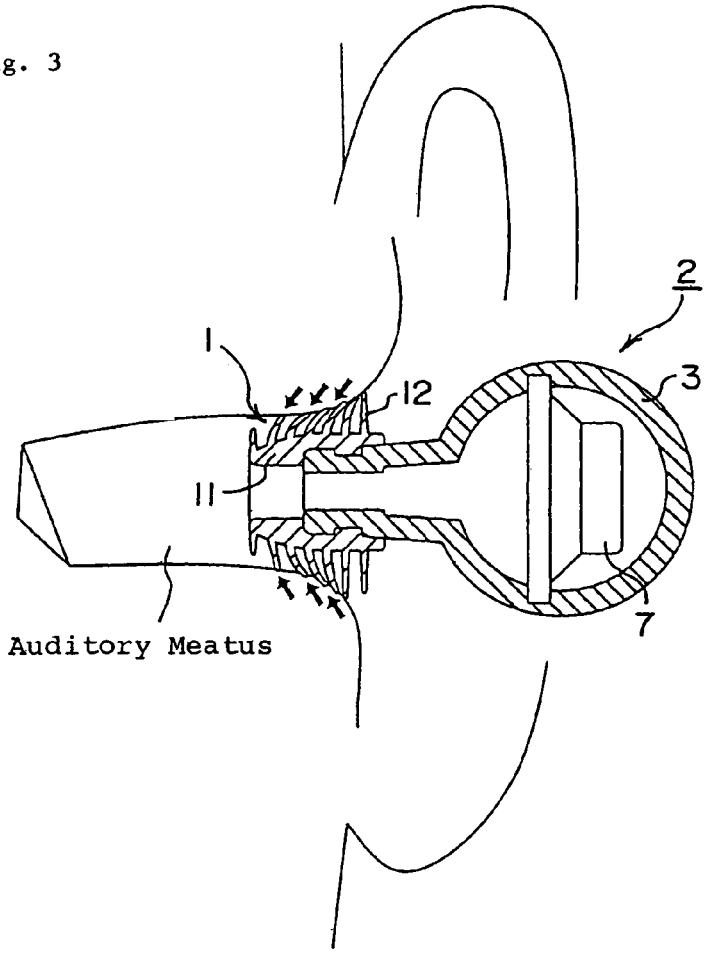
FIG. 3 is an explanatory view showing the actions.

An embodiment of the invention is described below with reference to the attached drawings each showing a case in which an embodiment of the present invention is applied to an earphone. In FIG. 1, the reference numeral 1 indicates an ear pad, and this ear pad is set at a tip section of the basic body 3 of an earphone 2. The basic body 3 of the earphone comprises a hollow and spherical body 4 and a hollow and cylindrical body 6 with a prescribed length monolithically formed in the projecting form from a portion of the spherical body and with the tip opening section 5 connected to inside of the spherical body 4. A speaker 7 is arranged within the spherical body 4 at a position facing the tip opening section 5 of the hollow cylindrical body 6. The hollow cylindrical body 6 has a tip with the diameter becoming gradually smaller toward its tip edge, and a circular hooking concave section 8 is formed on the outer peripheral surface of the tip section. A circular hooking convex section 9 formed on an inner peripheral surface of the ear pad 1 in the rear edge section is hooked in this hooking concave section 8, and with this configuration the ear pad 1 is set in the tip section of the basic body 3 of the earphone.

The ear pad 1 is made from silicone rubber adapted to a living body, and is detachably set in an auditory meatus as shown in FIG. 2A to FIG. 2D, and has a hollow and cylindrical basic body 11 with both of the front and rear edges opened. The outer peripheral surface of the basic body 11 in the front edge side has the diameter becoming smaller toward its tip, and a number of thin gathered sound-insulating walls made from the same material as the basic body 11 are monolithically provided with a prescribed space in the axial direction in the ring form with the diameter of the sound-insulating wall 12 becoming small toward its tip. These sound-insulating walls are provided in a direction perpendicular to the center line of the basic body 11. These sound-insulating walls 12 form a pad section 13 having a spherical expanded portion corresponding to the fit section 53 in the conventional technology. The hardness of the ear pad 1 is preferably any of 30, 40, and 50 degrees as measured with the JIS hardness scale.

The number of sound-insulating walls 12 is seven in this embodiment, and this is one of the preferable embodiments, and any number is allowable in the range from 5 to 10, and also 11 or more sound-insulating walls may be provided on the condition that the number thereof is close to 10. The maximum outer diameter D1 of the sound-insulating wall 12 is smaller than two times that of the outer diameter d of the basic body 11, while the minimum outer diameter D2 is a little larger than the outer diameter d of the basic body 11. The sound-insulating wall 12 does not stimulate sensitive portions of the auditory meatus and has the softness and adaptability to being set required for the ear pad 1, and the wall thickness T becomes smaller towards the outer peripheral edge. A space H between the adjoining sound-insulating walls 12 is larger than the wall thickness T of the sound-insulating wall 12. Although not shown in the figures, the entire ear pad 1 including the sound-insulating walls 12 includes a number of air bubbles, and the bubbles provide the sound-absorbing capability. The hooking convex section 9 of the ear pad 1 is formed between the circular concave section 14 formed at the rear edge section of the basic body 11 and the circular concave section 15 formed in the intermediate section thereof.

The best sizes of the various portions of the ear pad 1 are, for instance, as described below. The length L of the basic body 11 in the axial direction is 9 mm, the outer diameter is 8 mm, the maximum wall thickness T in the base section of the basic body 11 of the sound-insulating wall 12 is 0.5 mm, maximum outer diameter D1 is 14 mm, minimum diameter D2 is 8.5 mm, and the space H between the adjoining sound-insulating walls 12 is from 1 mm to 1.3 mm.

As described above, when the earphone 2 with the ear pad 1 is inserted in an auditory meatus from the tip side of the ear pad 1 facing the depth of the ear as shown in FIG. 3, the outer periphery of the sound-insulating wall 12 contacts the inner wall of the auditory meatus, and is gradually inserted with the sound-insulating walls 12 of the ear pad 1 contacting the inner wall being bent (fallen) backward up to the position where the ear pad 1 just fits in the auditory meatus. In this step, the sound-insulating walls 12 bite the inner wall of the auditory meatus in the wedge-like state, so that the inner wall of the auditory meatus deforms to hook the outer periphery of the sound-insulating walls 12 or the outer periphery of the sound-insulating walls 12 hook small irregularities on the inner surface of the auditory meatus, so that the force against release of the earphone is generated. Therefore the earphone can be set in the auditory meatus quite stably.

In the state where the earphone 2 is set in an auditory meatus as described above, the outer periphery of each of the sound-insulating walls 12 bent backward contacts the inner wall of the auditory meatus at pin points, and further a sealed space is formed between the adjoining sound-insulating walls 12. A deeper side of the auditory meatus is completely sealed toward outside, and many sealed spaces are formed in the deeper side, so that the sealing capability and the sound-insulating capability are extremely excellent. Therefore, external noises can effectively be attenuated primarily with the sound-insulating walls 12 having the sound-insulating capability, and secondarily with the sealed spaces.

To describe the actions of the sealed spaces in further detail, in contrast to the fact that there is only one fit section 53 having the sound insulating effect in the conventional type of ear pad 51, a number of sound-insulating walls 12 are provided, each independently, in this ear pad 1, and even if one of the sound-insulating walls 12 deforms and a space is generated in the deformed section, it does not influence other sound-insulating walls so long as the deformed portion does not contact other sound-insulating walls, so that each of the sound-insulating walls 12 individually fits the inner wall of the auditory meatus. The capability of attenuating external noises is substantially higher as compared to the conventional type of earphone.

As described above, the ear pad 1 according to the present invention seldom drops out after it is set in an auditory meatus and is extremely excellent in its capability of attenuating external noises, so that the ear pad 1 is very effective for use with the earphone 2 at noisy places, and is indispensable for countermeasures against noises.

Figure 4:
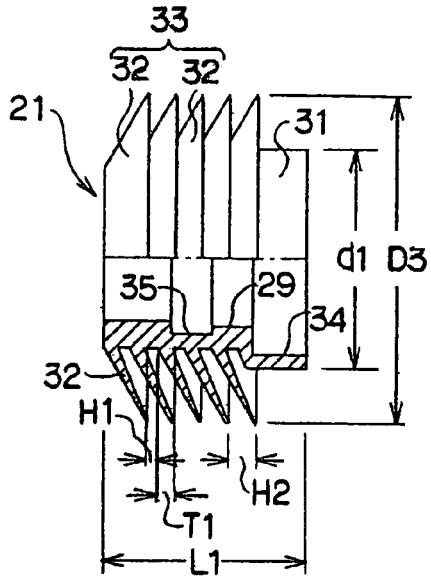
FIG. 4 is a partially-broken front view showing an ear pad according to another embodiment of the present invention in the state where a lower half portion thereof is broken.
Figure 5:
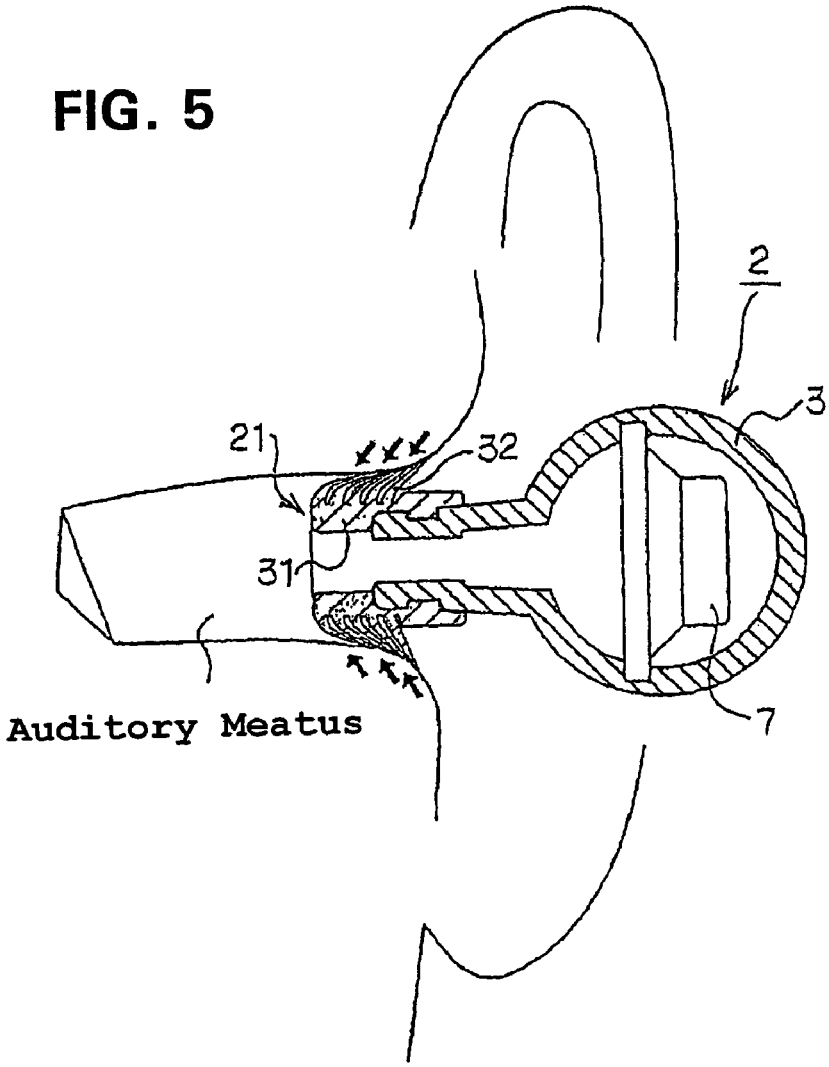
FIG. 5 is an explanatory view showing the actions.
Figure 6:
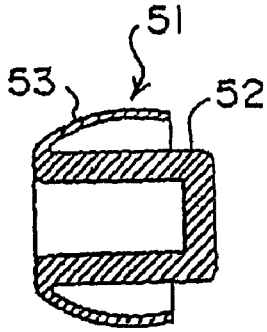
FIG. 6 (PRIOR ART)
FIG. 6 is a cross-sectional front view showing a case in which the conventional type of ear pad is applied to an ear plug.
Figure 7:
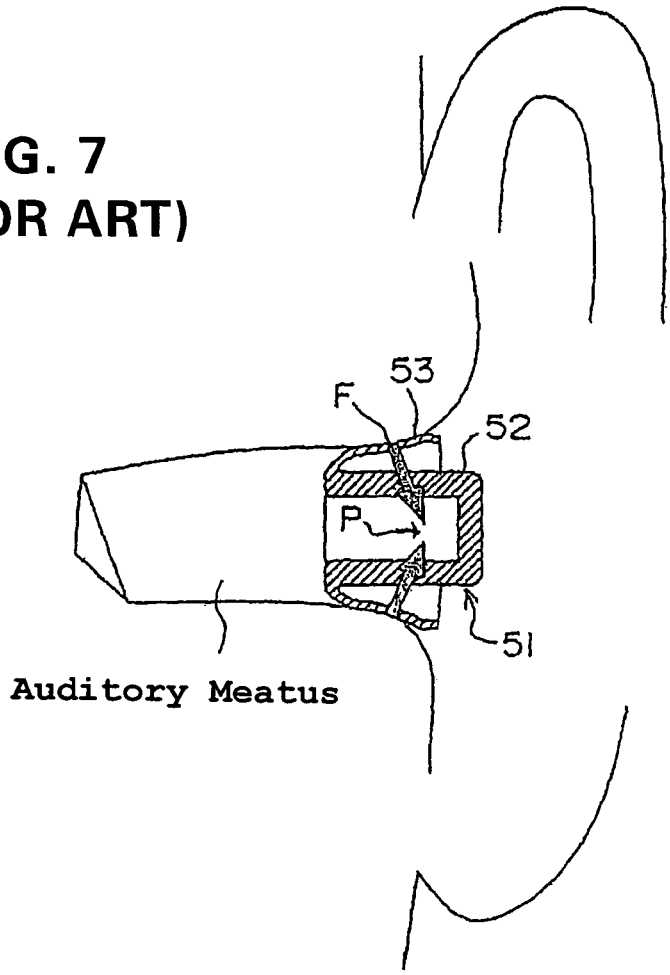
FIG. 7 (PRIOR ART)
FIG. 7 and FIG. 8 are views each showing the actions thereof.
Figure 8:
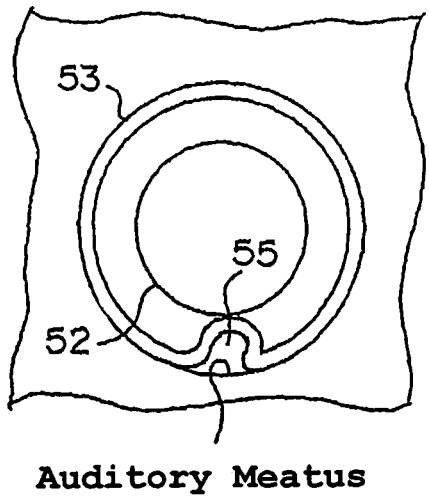
FIG. 8 (PRIOR ART)

FIG. 4 and FIG. 5 show another embodiment of the present invention. Also an ear pad 21 according to this embodiment is made of silicone rubber suited to a living body like the ear pad 1 described above and is set on a tip section of the basic body 3 of an earphone, and has a hollow and cylindrical basic body 31 with both of the front and rear edges opened. Like the basic body of the ear pad 1, the basic body 31 has a circular hooking convex section 29 at the intermediate section with circular concave sections 34, 35 formed before and beyond the convex section 29. On the other peripheral surface of the basic body 31, a number of thin gathered sound-insulating walls 32 made of the same material as the basic body 31 are monolithically provided in a ring form with a prescribed space in the axial direction. The number of sound-insulating walls 32 form a pad section 33 corresponding to the conventional type of fit section 53.

In this embodiment, five sound-insulating walls 32 are provided, but this is only one of the preferred embodiments, and any number of sound-insulating walls may be provided in the range from not less than five and not more than ten, and even 11 or more sound-insulating walls may be provided on the condition that the number is close to 10. The sound-insulating wall 32 has the same diameter in the entire body, and is slightly slanted to the rear edge side. The outer diameter D3 of the sound-insulating wall 32 is smaller than two times of the outer diameter d1 of the basic body 31. The sound-insulating wall 32 does not stimulate sensitive portions of an auditory meatus and has the softness and adaptability to being set generally required for the ear pad 21, because the wall thickness T1 becomes smaller toward the outer periphery thereof. A space H1 between the sound-insulating walls 32 is smaller than the wall thickness T1 of the sound-insulating wall 32, but the space H1 may be larger. Although not shown in the figure, the ear pad 21 including the sound-insulating wall 32 includes a number of air bubbles in the entire portion, and the sound-absorbing performance is provided by the bubbles.

The best sizes of the ear pad 21 in its various portions are, for instance, as described below. The length L of the basic body 31 in the axial direction is 7.5 mm, the outer diameter D3 is 12 mm, the maximum wall thickness T1 in the base section of the basic body 31 of the sound-insulating wall 32 is 0.6 mm, and the space H1 between the adjoining sound-insulating walls 32 is 0.5 mm, and the space H2 between the outer peripheries of the sound-insulating walls 32 is 1 mm.

When the ear pad 21 is set on the earphone 2 and the earphone 2 is inserted into an auditory meatus, the sound-insulating walls 32 bite the inner wall of the auditory meatus in the wedge-like state, so that the earphone 2 is set in the extremely stable state. Further like in the embodiment described first, sealed spaces are formed between the sound-insulating walls 32 in this state, and the same effects as those in the first embodiment including the excellent sealing and sound insulating capability are provided. Further, in this embodiment, the sound-insulating walls 32 are slightly slanted backward to the rear edge side, so that the load to the user's ear including the pain generated when the ear pad 1 is set in the user's auditory meatus is further lower as compared to that when the ear pad 1 according to the embodiment described first is used, and in addition, as the outer peripheries of all the sound-insulating walls 32, each having the same outer diameter contact the inner wall of the auditory meatus as shown in FIG. 5 and no space connecting to the atmospheric space or a space inside the auditory meatus is generated in the sealed space between the adjoining sound-insulating walls, and because of the configuration, the sealing capability is higher with external noises further attenuated, so that, when sounds generated inside the auditory meatus are collected and covered to signals, the voice recognition is further improved.

In the embodiments of the present invention described above, the basic bodies 11, 31 and the sound-insulating walls 12, 32 are made of silicone rubber, but other materials including rubbers such as urethane rubber or soft synthetic resins such as polypropylene may be used. Also in the embodiments, the ear pads 1, 21 are set each on the earphone 2, but the ear pad according to the present invention can be applied not only to an earphone, but also to all of the devices set in an ear such as a hearing aid or an ear plug. Further, only the speaker 7 is provided in the earphone 2, but it is needless to say that a microphone may be arranged in addition to the speaker in the earphone 2.

What is claimed is:

1. An ear pad adapted to being inserted and detachably set in an auditory meatus and having a structure in which, on an outer peripheral surface of a hollow and cylindrical basic body made of an elastic material, a number of gathered sound-insulating walls made of the same material as the basic body are monolithically annularly provided on the basic body at predetermined intervals in the axial direction, the sound-insulating walls having a diameter which decreases toward the front of the pad, extending in a direction perpendicular to the center line of the basic body and having a wall thickness that reduces toward the outer periphery thereof, each wall contacting an inner wall of the auditory meatus with a peripheral edge bend thereof which extends toward the rear of the basic body such that several sealed spaces are formed for attenuating outside noise by bent walls which overlap and adjoin an adjacent wall at outer peripheral edges thereof when the ear pad is placed in the auditory meatus.

* * * * *